United States Patent [19]

Wolf

[11] Patent Number: 4,524,753

[45] Date of Patent: Jun. 25, 1985

[54] INFRA-RED HEATING APPARATUS

[76] Inventor: Daniel Wolf, 9200 Prospect Ave., Louisville, Ky. 40222

[21] Appl. No.: 440,953

[22] Filed: Nov. 12, 1982

[51] Int. Cl.[3] ..... F24C 3/04

[52] U.S. Cl. ..... 126/99 R; 126/92 C; 126/116 R

[58] Field of Search ..... 126/92 A, 92 AC, 92 B, 126/110 B, 116 R, 92 R, 91; 431/328, 329

[56] References Cited

U.S. PATENT DOCUMENTS

| | | | |
|---|---|---|---|
| 1,158,652 | 11/1915 | Doyle | 126/92 C |
| 1,217,551 | 2/1917 | Armor | 126/92 C |
| 1,582,657 | 4/1926 | Andrews | 126/92 AC |
| 1,611,983 | 12/1926 | Andrews | 126/92 AC |
| 1,652,438 | 12/1927 | Hicks | 126/92 AC |
| 1,755,727 | 4/1930 | Cramer | 126/92 AC |
| 2,082,337 | 6/1937 | Hays | 431/328 |
| 2,308,887 | 1/1943 | McCollum | 431/328 |
| 2,379,017 | 6/1945 | McCollum | 431/328 |
| 2,712,352 | 7/1955 | Manor | 431/328 |
| 2,916,032 | 12/1959 | Kitchen | 126/116 R |
| 3,155,142 | 11/1964 | Stack | 431/328 |
| 3,167,066 | 1/1965 | Hughes | 431/328 |
| 3,187,798 | 6/1965 | Pokorny | 431/328 |
| 3,203,413 | 8/1965 | Hartzell et al. | 126/92 B |
| 3,260,460 | 7/1966 | Marland | 126/92 B |
| 3,279,455 | 10/1966 | Corey | 126/92 B |
| 3,410,559 | 11/1968 | Miller | 431/328 |
| 3,561,422 | 2/1971 | Colin-Smith | 126/92 B |
| 3,751,213 | 8/1973 | Sowards | 431/328 |
| 3,805,763 | 4/1974 | Cowan | 431/329 |
| 3,965,885 | 6/1976 | Wiesenthal | 126/110 R |
| 4,105,158 | 8/1978 | Hasebe | 431/184 |

*Primary Examiner*—James C. Yeung

*Attorney, Agent, or Firm*—Charles G. Lamb

[57] ABSTRACT

An infra-red heating apparatus includes a radiating surface and an adjacently located black body receiver spaced from the radiating surface. A fuel supply plenum is located adjacent to the radiating surface to provide jets of fuel along the radiating surface to be ignited thereby. Fins of heat radiating material are attached to the black body receiver and project therefrom into an air duct. Air moving through the air duct is heated as it passes over the fins.

10 Claims, 2 Drawing Figures

INFRA-RED HEATING APPARATUS

BACKGROUND OF THE INVENTION

1. Field of the Invention

The present invention relates to radiant heaters, and more particularly to a radiant infra-red heater for heating an air stream which in turn is used to heat an enclosure.

2. Discussion of the Prior Art

Various types of radiant heaters are known. Examples of known radiant heaters are discussed in U.S. Pat. No. 2,916,032; U.S. Pat. No. 3,190,556; U.S. Pat. No. 3,260,460; U.S. Pat. No. 3,805,763 and U.S. Pat. No. 3,827,424.

However, the radiant heaters are known to be relatively complicated and, therefore, expensive to manufacture, install and maintain in efficient operation. Also, none are presently known for use in a heating system using circulating air as the heat transfer medium.

SUMMARY OF THE INVENTION

The present invention advantageously provides a radiant infra-red heater which is relatively inexpensive to install and maintain in efficient operation. Furthermore, the present invention provides a radiant heater device which is equally suitable for heating small spaces such as houses and larger spaces such as manufacturing plants, theaters and the like.

More particularly, the present invention provides an infra-red heating apparatus comprising a radiating surface spaced from a black body receiver, an air duct adjacent the black body receiver, means for supplying fuel along the surface of the radiating surface, means for directing fuel from a fuel supply means along the radiating surface, ignition means for igniting the fuel at the radiating surface, and heat radiating surfaces projecting from the black body receiver into the air duct whereby air passing through the air duct is heated as it passes the heat radiating surfaces.

BRIEF DESCRIPTION OF THE DRAWINGS

A clear understanding of the present invention will be gained upon reference to the following description in conjunction with the drawings in which like numerals refer to like parts and wherein.

DETAILED DESCRIPTION

Figure 1:
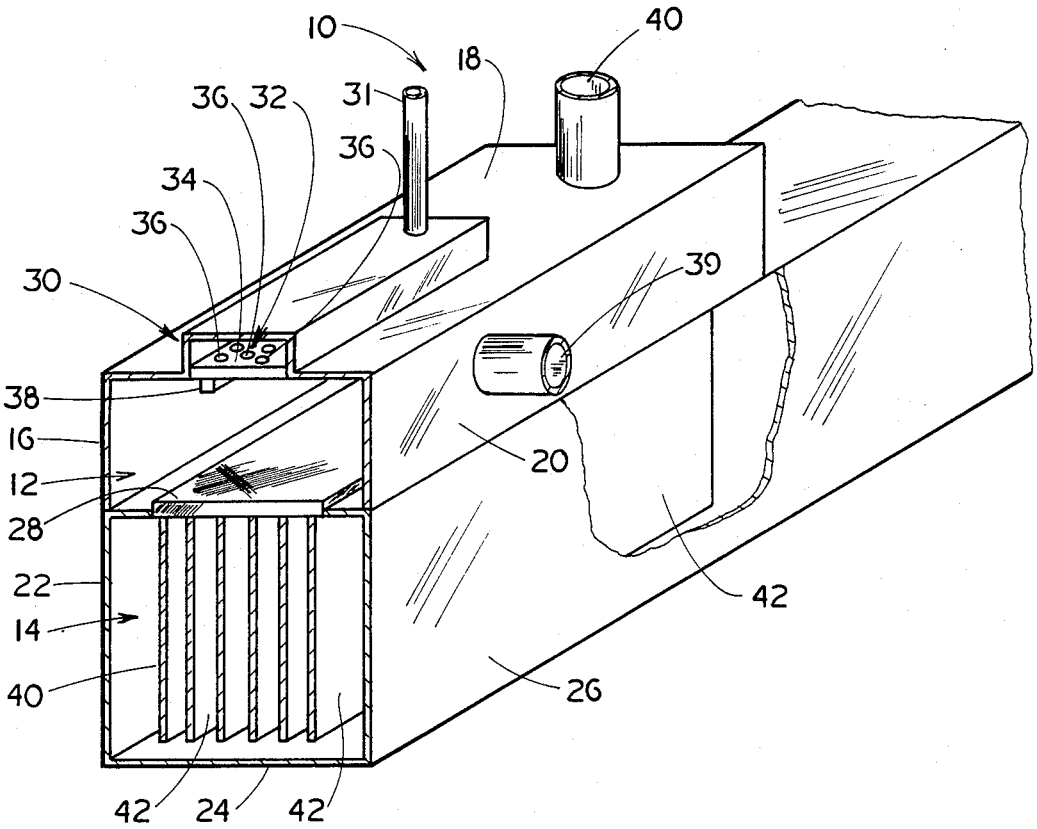
FIG. 1 is a schematic, perspective view of an infra-red heating device embodying the present invention; and, FIG. 2 is a schematic, cross-sectional view of another infra-red heating device embodying the present invention.

With reference to FIG. 1, there is shown an infra-red heating apparatus, generally denoted as the numeral 10, for heating a gaseous medium such as, for example, air. The heated air can be used to heat an enclosure, such as a house, by routing the heated air through appropriate air ducts for distribution to the space to be heated.

The apparatus 10 is shown as comprising a combustion chamber 12 and an adjacently located air duct 14. The combustion chamber 12 and air duct 14 are illustrated as having generally rectangular traverse cross-sectional shapes, however, it should be understood that other shapes can be used. The exterior boundary walls 16, 18 and 20 of the combustion chamber 12 and the exterior boundary walls 22, 24 and 26 of the air duct 14 can be fabricated of virtually any heat resistant material such as, for example, sheet metal, and can be overlayed by an insulation material if desired. The interfacing wall 28 between the combustion chamber 12 and air duct 14 is shown as a common wall. The interfacing wall is preferably a black body receiver fabricated of, for example, silica sand, so that it is capable of absorbing large amounts of radiant energy.

Fuel supply means, generally denoted as the number 30, is provided and shown as a plenum chamber having a generally rectangular cross-section disposed above the combustion chamber 12 and spaced from interfacing wall (black body receiver) 28. A radiating surface 32 is provided to radiate energy toward the black body receiver 28 and includes a wall 34 of the fuel supply plenum chamber formed with apertures 36 therein which function as fuel nozzles. The wall 34 of the fuel supply plenum is oriented in facing relationship to the interfacing wall 28 so that the apertures 36 direct jets of fuel issuing therethrough toward the interfacing wall 28. Preferably, the apertured wall 34 of the fuel supply plenum chamber is spaced from the interfacing wall 28 by an appropriate distance such that the jets of fuel issuing from the aperture 36 will be ignited and excite the surface 32 to radiate energy toward the interfacing wall 28. The radiating surface 32 is preferably fabricated of a heat absorbing material such as a ceramic material.

Ignition means, such as a pilot burner or spark igniter 38, is located at the exterior surface of the apertured wall 34 of the fuel supply plenum to ignite the jets of fuel leaving the nozzle apertures 36.

Combustion air can be supplied to the combustion chamber 12 by virtually any convenient means such as, for example, a combustion air inlet port 39. Similarly, the products of combustion can be exhausted from the combustion chamber 12 by any number of means such as, for example, an exhaust port 40.

The infra-red heating apparatus 10 further includes a plurality of fins 42 which are attached to the interfacing wall 28 and project into the air duct 14. As shown, the plurality of fins 42 are located in spaced apart parallel relationship across the flow path of the air duct 14 and are oriented such that the spaces between adjacent fins provide for the passage of air across the surfaces of the fins as the air flows through the air duct. The fins 42 are fabricated of a material having a high coefficient of thermal conductivity such as, for example, copper or aluminum. Thus, heat absorbed by the interfacing wall (black body receiver) 28 moves to the fins 42 and the fins 42 provide heat radiating surfaces in the air duct for heating the air moving in the air duct as the air passes over the surfaces of the fins 42.

Figure 2:
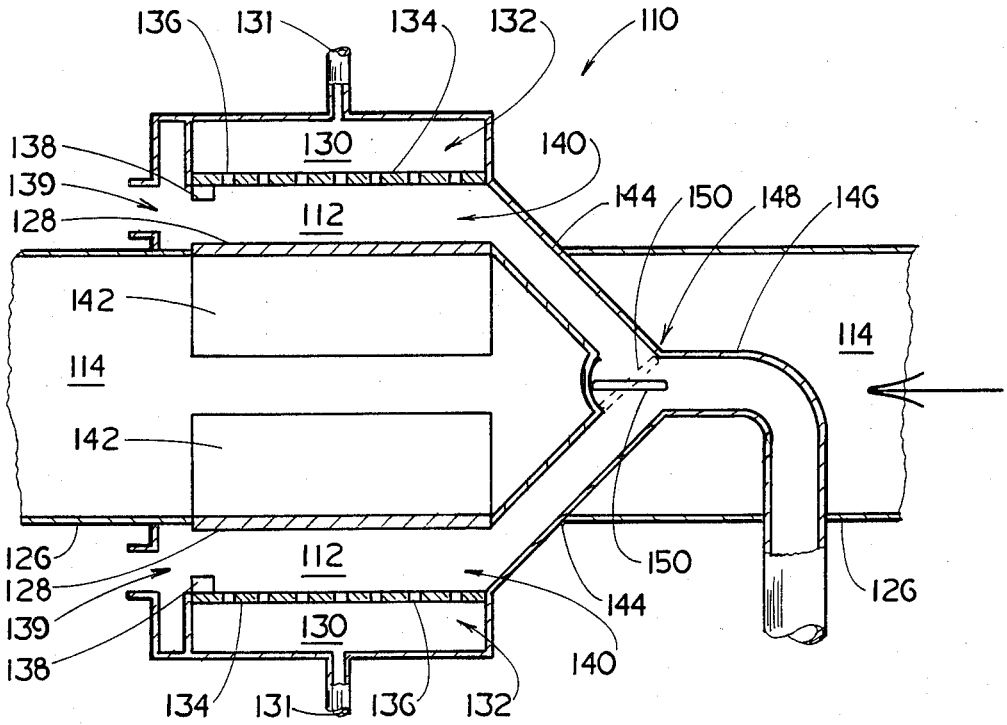

Now turning to FIG. 2, there is shown another advantageous infra-red heating apparatus, generally denoted as the numeral 110, for heating air.

The apparatus 110 is illustrated as comprising two combustion chambers 112 located to opposite lateral sides of and adjacent to an air duct 114. The exterior boundary walls of the combustion chambers 112 and the exterior walls of the air duct 114 can be fabricated of any heat resistant material such as, for example, sheet metal, and can be overlayed by an insulation material if desired. The interfacing wall (black body receiver) 128 between each of the combustion chambers 112 and the air duct 114 is shown as a common wall. The interfacing walls 128 are preferably a black body fabricated of, for example, silica sand, so that they are capable of absorbing large amounts of radiant energy.

Fuel supply means, generally denoted as the number 130, are provided and shown as a different plenum chamber disposed above each of the combustion chambers 112 and spaced from the interfacing wall 128. Each fuel supply plenum chamber includes a fuel feed 131 for introducing fuel into its associated supply plenum chamber 130 and a radiating surface, generally denoted as the number 132, to radiate energy toward the black body receiver 128. Each radiating surface 132 comprises a wall 134 of the fuel supply plenum chamber formed with apertures 136 therein which function as fuel nozzles. The wall 134 of each fuel supply plenum is oriented in facing relationship to the interfacing wall 128 so that the apertures 136 direct jets of fuel issuing therethrough toward the interfacing wall 128. Preferably, the apertured wall 134 of each fuel supply plenum chamber is spaced from the interfacing wall 128 associated therewith by an appropriate distance such that the jets of fuel issuing from the apertures 136 will be ignited and excite the surface 132 to radiate energy toward the interfacing wall 128. The radiating surfaces 132 are preferably fabricated of a heat absorbing material such as a ceramic material.

Ignition means, such as a pilot burner or spark igniter 138 is located at the exterior surface of the apertured wall 134 of each fuel supply plenum to ignite the jets of fuel leaving the nozzles 136.

Combustion air can be introduced into the combustion chambers 112 by virtually any convenient means. As shown in FIG. 2, each combustion chamber 112 is equipped with a combustion air inlet port 139 for this purpose.

The products of combustion can be exhausted from each combustion chamber 112 through an exhaust port 140 in each chamber.

The infra-red heating surface apparatus 110 further includes fins 142 which are attached to each of the interfacing walls 128 and project into the air duct 114. While it is contemplated that each fin 142 could be attached to both interfacing walls 128 and, therefore, extend completely across the air duct 114, the embodiment of FIG. 2 illustrates some of the fins 142 attached to the interfacing wall 128 of one of the combustion chambers and other fins 142 attached to the interfacing wall 128 of the other combustion so that the fins 142 project into the air duct 114 toward each other from opposite sides of the air duct 114. The fins 142 attached to each interfacing wall 128 are located in spaced apart, parallel relationship across the flow path of the air duct 114 and are oriented such that the spaces between adjacent fins provide for the passage of air across the surfaces of the fins as the air flows through the air duct. The fins 142 are fabricated of a material having a high co-efficient of thermal conductivity such as, for example, copper or aluminum. Thus, heat absorbed by the interfacing walls 128 moves to the fins 142 attached thereto, and the fins 142 provide heat radiating surfaces in the air duct 114 for heating the air moving in the air duct as the air passes over the surfaces of the fins 142.

In order to conserve energy, the heat of the hot products of combustion is used to supplement the heating effect of the fins 142 by pre-heating the air flowing in the air duct 114. Toward this end, the hot products of combustion are routed through the air duct 114 upstream, relative to the flow of air (indicated by the flow arrow) in the air duct 114, from the fins 142 so that the air flowing in the air duct will absorb heat from the hot combustion products. To accomplish this end, as shown in FIG. 2, two branch exhaust conduits 144 are used to channel hot combustion products from each of the two combustion chambers 130 into the air duct 114. Each branch exhaust conduit 144 is in flow communication with the exhaust port 140 of a different one of the combustion chambers 130 and extend therefrom into approximately the geometric center of the air duct where they intersect. A main exhaust conduit 146 is in flow communication with both branch exhaust conduits 144 at their intersection and extends therefrom for a distance generally longitudinally of the air duct 114 before it turns and passes out of the air duct. The branch exhaust conduits 144, main exhaust conduit 146 and air duct 114 are appropriately sealed so that no products of combustion will leak into the air stream flowing in the air duct. A flow control valve, generally denoted as the number 148, is located at the intersection of the branch exhaust conduits 144 inside the air duct 114 so that the flow of combustion products from each combustion chamber 130 can be modulated to conform to the amount of exhaust products produced by each combustion chamber. The flow control valve 148 further allows either one of the exhaust branch conduits 144 to be completely closed in the event only one of the combustion chambers 130 is being used to heat the air flowing in the air duct 114. As shown, the flow control vavle 148 includes a pivotal valve plate 150 which can be pivoted from outside the air duct to partially close or completely close either one of the exhaust branch conduits. The pivotal valve plate 150 is shown in solid lines in a position providing equal flow from the branch exhaust conduits, and in broken lines completely closing the branch exhaust conduit from one of the combustion chambers. In operation, as heated air flows in the air duct 114 from the fins 142, the hot air passes over the branch exhaust conduits 144 and main exhaust conduit 146 whereby the air absorbs additional heat from the hot combustion products being exhausted from the combustion chambers 130.

The infra-red heating apparatuses 10 and 110 can be used with virtually any fluid fuel such as natural gas, propane, butane or liquified propane. In addition, a heating system can comprise more than one of the infra-red heating apparatuses arranged for example, in branched configuration.

The foregoing detailed description is given primarily for clearness of understanding and no unnecessary limitations are to be understood therefrom for modifications will become obvious to one skilled in the art upon reading this disclosure and may be made without departing from the spirit of the invention and scope of the appended claims.

What is claimed is:

1. An infra-red heating apparatus, comprising:

an air duct;

a combustion chamber located adjacent said air duct;

a black body receiver adjacent said air duct and said combustion chamber;

a fuel supply plenum chamber adjacent said combustion chamber;

a radiating surface disposed between said fuel supply plenum chamber and said combustion chamber, said radiating surface being spaced from and generally facing said black body receiver;

means for directing fuel along said radiating surface and generally in a direction toward said black body receiver;

ignition means for igniting the fuel at said radiating surface; and, heat radiating surfaces projecting from said black body receiver into said air duct whereby air passing through said air duct is heated as it passes said heat radiating surfaces.

2. The infra-red heating apparatus defined in claim 1, wherein said radiating surface comprises means defining fuel nozzles in said radiating surface for supply fuel along the surface of said radiating surface.

3. The infra-red heating apparatus defined in claim 2, wherein said radiating surface is fabricated of a ceramic material.

4. The infra-red heating apparatus defined in claim 2, wherein said ignition means is located to ignite the fuel at the exterior surface of said radiating surface facing said black body receiver.

5. The infra-red heating apparatus defined in claim 1, wherein said black body receiver is a wall interfacing with said air duct.

6. The infra-red heating apparatus defined in claim 1, wherein said heat radiating surfaces comprise a plurality of spaced apart fins attached to said black body receiver.

7. The infra-red heating apparatus defined in claim 6, wherein said fins are fabricated of a metal having a high modulus of heat transfer.

8. The infra-red heating apparatus defined in claim 1, further comprising exhaust means for routing hot products of combustion through said air duct upstream, relative to the flow of air through said duct, of said heat radiating surfaces.

9. The infra-red heating apparatus defined in claim 8, further comprising flow control means for controlling the flow of hot products of combustion through said exhaust means.

10. The infra-red heating apparatus defined in claim 1, wherein said black body receiver and said radiating surface cooperate to define a combustion chamber located outside of said air duct.

* * * * *